United States Patent [19]

Lehmann

[11] 4,039,831

[45] Aug. 2, 1977

[54] TWO COLOR XERORADIOGRAPHY DEVELOPMENT

[75] Inventor: Ernest H. Lehmann, Arcadia, Calif.

[73] Assignee: Xerox Corporation, Stamford, Conn.

[21] Appl. No.: 622,790

[22] Filed: Oct. 15, 1975

[51] Int. Cl.[2] ..... G03G 13/00; G03G 15/00

[52] U.S. Cl. ..... 250/315 A; 96/1.2

[58] Field of Search ..... 250/315 A, 315 R; 96/1.2

[56] References Cited

U.S. PATENT DOCUMENTS 2,879,397 3/1959 Lehmann ..... 250/315 A

*Primary Examiner*—Eli Lieberman

*Assistant Examiner*—T. N. Grigsby

*Attorney, Agent, or Firm*—James J. Ralabate; Franklyn C. Weiss; Anthony W. Karambelas

[57] ABSTRACT

A xeroradiographic system employing both fringe field and absolute development in order to provide both enhancement of sharply changing boundaries as well as imaging slowly changing borders is provided. This is accomplished by first developing the image with a colored toner in the fringe field i.e. far spaced electroded mode and then developing the electrostatic image in the absolute mode i.e. employing a closely spaced electrode to the latent electrostatic image with a contrasting colored toner.

6 Claims, 6 Drawing Figures

TWO COLOR XERORADIOGRAPHY DEVELOPMENT

BACKGROUND OF THE INVENTION

This invention relates in general to xeroradiographic imaging and, in particular, to a new improvement in xeroradiographic imaging.

The xeroradiography relates to the recording of X-ray patterns and information by means of materials and devices whose electrical conductivity is altered by the action of penetrating radiation, such as X-rays and the like. In the xeroradiographic process, a normally insulating X-ray sensitive layer overlaying a conductive backing surface may be charged electrically and used as a radiation sensitive recording surface because of conductivity imparted by the radiation. Thus, the appropriate surface, such as, for example, a conductive metallic surface having a vitreous or amorphous selenium photoconductive layer, may be charged and exposed to an X-ray pattern, as disclosed in Schaffert U.S. Pat. No. 2,666,144. A latent electrostatic image is thereby provided or a xeroradiographic latent image which may be developed by dusting with finely divided charged particulate material referred to in the art as toner to form a visible image.

Normally, the electrostatic latent image is developed by presenting the plate bearing the image to a cloud or gas suspension of charged powder particles or toner. The image as developed in this way, see Jeromin et al U.S. Pat. No. 3,640,246, has a remote grid with a backing bias to distinguish the polarity of toner desired to be used in the development of the image. This remote electrode developed image is characterized by the emphasis of the development of electrostatic fringe fields created by discontinuities between charged and lower charged areas. These developed images are distinguished by a "halo" of undeveloped or lightly developed region around these different potential areas. The size and degree of this "halo" is a function of the degree of potential difference and of the sharpness of the discontinuity. In a true fringe field developed image there is no developed density difference between the central regions of each potential area. The image is recognized purely by the "halo" which results in a pseudodensity difference, well known as the Cornsweet Effect. When a very close spaced electrode is used an absolute development occurs. The toner deposited on the plate is a function of the charge potential and there is no fringe effect. In actual practice, neither of these exist in true form and a combination of these exists in the Jeromin et al Patent and co-pending Klingenberg and Klingenberg et al applications, Ser. Nos. 525,698, filed Nov. 21, 1974, and 525,697, filed Nov. 21, 1974, now U.S. Pat. No. 3,974,796, respectively which are hereby incorporated by reference. The former patent is characterized by emphasis on fringe field development, and in the latter applications, the tendency is toward absolute development. The apparatus disclosed in Klingenberg applications may be utilized to provide both the far spaced and close spaced electroded modes since it provides a movable grid.

The halo property however, which is the very property which produces these preferential results, produces an additional and in some cases an undesirable result. Very frequently in X-ray examination it is desired, for example, in examining industrial castings or the like, to locate casting flaws or, in medical examination to locate and analyze tissue and bone areas when the area of particular interest in the X-ray examination is an area at or near a point of sharp contrast differential. Thus, in medical examination, it may be desired to detect a bone injury at or near a joint or, in an industrial examination, it may be desirable to detect flaws which might be more prevalent near seams, joints, or sharp contour changes in the test object. For example, if a casting is being analyzed by X-ray examination, the purpose of the examination very often is to detect the presence or absence of flaws associated with sharp angles in the surfaces. It is exactly this type of flaw that could occur in the halo area of the xeroradiographic plate and which is somewhat more likely to be partially missed by the halo itself.

In medical examinations, and more specifically, in xeromammography applications, it is of utmost importance that edge enhancement be present but in addition it may be desirable that areas adjacent to areas having high edge enhancement be made readily visible to the investigator. This capability may be extremely desirable to the medical technician in certain investigations. In addition, it is also desirable in such examinations to detect soft tumors or growths or structures which do not have sharply defined edges or slowly changing boundaries.

It is therefore an object of this invention to provide a xeroradiographic imaging system devoid of the above-noted deficiencies.

It is another object of this invention to provide a novel system for xeroradiographic examination having increased readability of the X-ray record in areas of sharply varying contrast.

Still another object of this invention is to provide a novel xeroradiographic system having enhanced contrast sensitivity with particular reference to contrast sensitivity in areas of sharp contrast gradation.

Again another object of this invention is to provide a xeroradiographic imaging system which possesses edge enhancement in addition to the ability to image slowly changing boundaries.

Yet another object of this invention is to provide a novel xeromammographic imaging system edge providing enhancement of calcifications as well as imaging slowly changing borders such as found in soft tumors.

These and other objects of the instant invention are accomplished, generally speaking, by providing a xeroradiographic system which employs both fringe field and absolute development. This is accomplished by first developing the image with a colored toner in the fringe field, i.e., far spaced electroded mode, and then developing the electrostatic image in the absolute mode, i.e., employing a closely spaced electrode to the latent electrostatic image with a constrasting colored toner.

A xeroradiographic plate, for example, a layer of photoconductive selenium disposed over a conductive aluminum substrate, is charged and then exposed to penetrating radiation which passes through a test object to be imaged resulting in the formation of a xeroradiographic latent image. This image is then developed employing a conventional powder cloud development type system with the exception that a far spaced electrode is employed allowing development in the fringe field to provide edge enhancement. In this first development broad area coverage is suppressed and edge enhancement is emphasized. Development of a fringe field results in edge enhancement and produces a halo effect. The plate is then subjected again to the same powder cloud development but during this step the system is electroded so that absolute development is provided with the use of an electrode closely spaced to the xeroradiographic plate to provide broad area coverage and suppress edge enhancement. Broad area coverage is accomplished in the close spaced electrode mode, i.e., absolute development because the closely spaced electrode causes the otherwise wandering field to orient and stand so that when toner is pulsed onto the plate by employing a conventional powder cloud system development is effected directly in relation to the charge remaining on the surface of the xeroradiographic plate since the field is made to stand substantially perpendicularly from the xeroradiographic plate.

In U.S. Pat. No. 2,879,397, having a common assignee and the identical inventor, a similar but distinguishable system is provided wherein development of the halo areas is accomplished. In the Lehmann patent, a dual development procedure is employed in which a xeroradiographic latent image is first developed under conditions enhancing detail presentation in certain areas of the image, and the image is subsequently developed under different conditions of opposite charge, enhancing detail presentation in the remaining areas of the image. According to Lehmann, this is accomplished by successive development steps in one of which the development is carried out with a cloud or gas suspension of finely divided particles of one color and electrical polarity followed by a second development step with a cloud or gas suspension of particles of a contrasting color in opposite electrical polarity. This dual operation results in particles of one color preferentially deposited or developed in relatively large areas and areas of gradual contrast differential, whereas particles of the contrasting color are preferentially developed or deposited in what are normally the halo areas of a xeroradiographic print. Thus, Lehmann produces a xeroradiographic print retaining essentially the advantages of enhanced readability produced by the halo characteristic while at the same time substantially overcoming the masking effect of halo with respect to sharp contrast areas. However, Lehmann employs a distinctly different process which does not employ a far spaced and close spaced electrode and therefore does not obtain both edge enhancement and broad area coverage which allows detection of slowly changing boundaries as does the instant invention. The process of the instant invention, therefore, constitutes a substantial advance over the Lehmann xeroradiographic system.

In Hukase et al, U.S. Pat. No. 3,854,043, an electrostatic latent image formed on a photoconductive layer by means of X-ray electrophotography is divided into at least two regions by the degree of electrostatic potential, said regions being represented by different colors by depositing a different color developer powder on each of said regions. Thus, Hukase et al employs biased development with one colored toner of a given polarity and then bias develops again at a different level with a contrasting colored toner of the same charge. Through this distinguishable process, Hukase et al allows development of different thicknesses with different colors but does not provide both edge enhancement and the ability to image slowly changing boundaries by employing a far spaced and close spaced electrode as in the system of the instant invention.

The general principles of the instant invention having been generally described and explained, the specifics of the instant invention will be more clearly understood with reference to the drawings of which:

Figure 1:
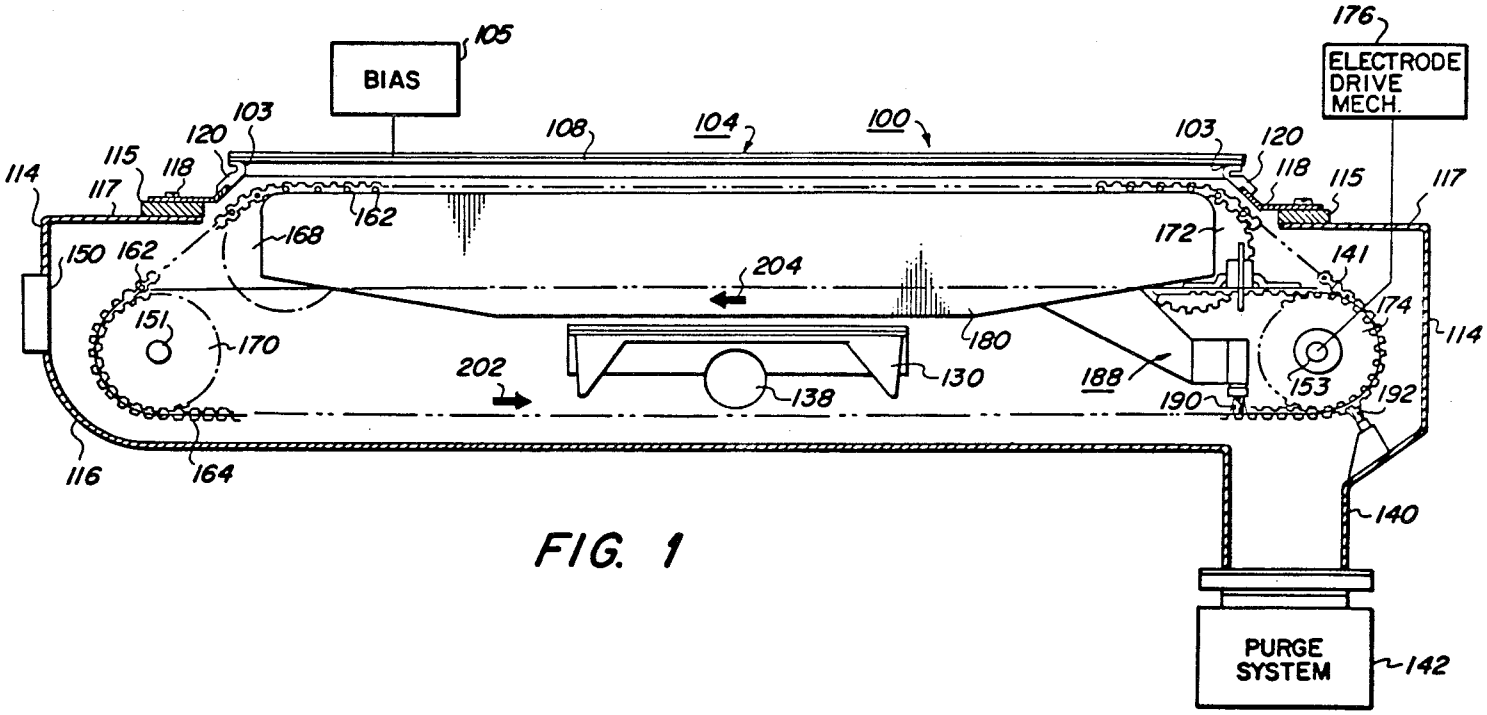
FIG. 1 is a simplified cross-sectional view of a powder cloud development apparatus operating in the close spaced electroded mode or in the absolute development mode.
Figure 2:
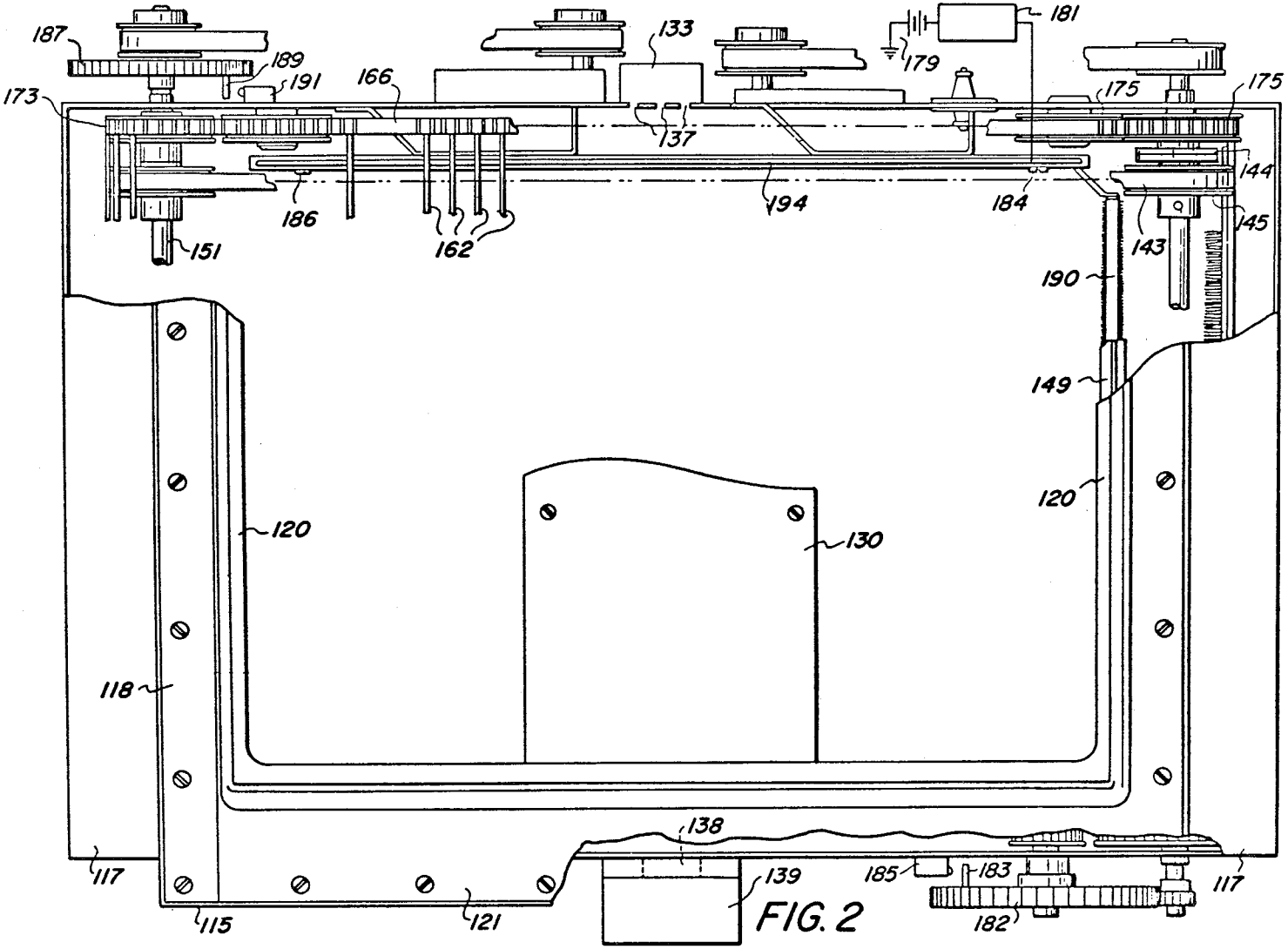
FIG. 2 is a top plane view of the development apparatus of FIG. 1 with the xeroradiographic plate removed.
Figure 3:
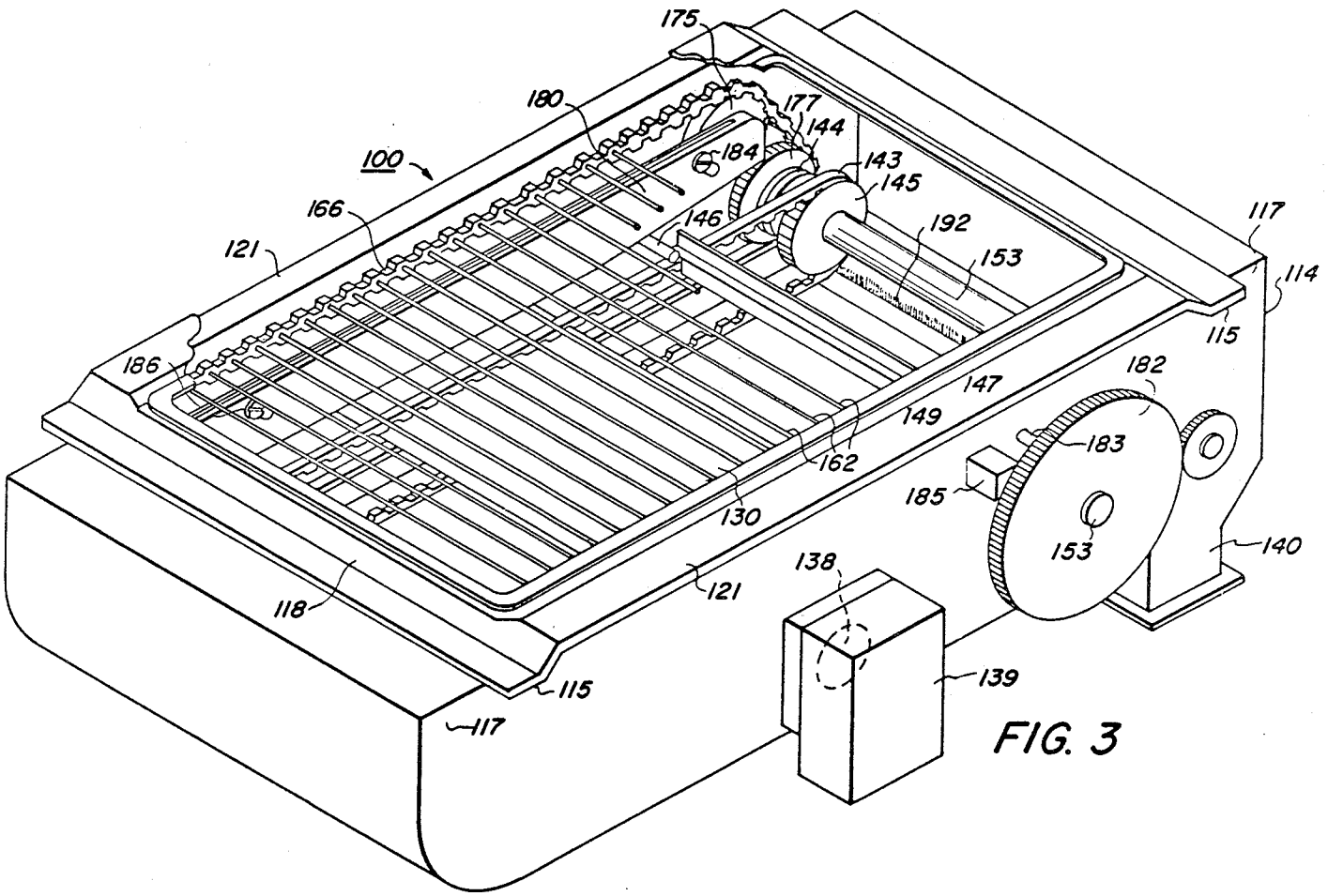
FIG. 3 is a perspective view, partially in cross-section, of the development apparatus employed in the close spaced electroded mode or in the absolute development mode.

Referring to FIGS. 1–3, development means 100 includes a xerographic plate 104 having a conductive backing member 106 and downwardly facing photoconductive layer 108 therein. The development means described herein may be utilized in the automated flat plate xerographic processing system described in U.S. Pat. No. 3,650,620. As more fully described in the U.S. Pat. No. 3,650,620 means are provided to advance a latent electrostatic image-bearing xerographic plate into the development means and to advance the xerographic plate out of the development means after the latent electrostatic image has been converted to a corresponding xerographic powder image. Portions of the U.S. Pat. No. 3,650,620 which are necessary for complete understanding of the present invention or to provide sufficient disclosure to understand the more fully automated operation of the development chamber described herein are incorporated by reference.

The sidewalls 114 and 116 of development chamber 100 terminate, about the upper periphery thereof, in an inwardly extending lip 117. A gasket supporting member 118 having a gasket (or seal) 120 on the upper portion thereof is attached to lip 117 via support member 115. Xerographic plate 104 is positioned by appropriate transport mechanisms adjacent the development station, the xerographic plate being lowered by elevator means (not shown) such that gasket 120 and felt strips 121 is caused to seat against the non-photoconductive portions 103 of the conductive backing member whereby a toner tight development chamber is defined.

Below the xerographic plate and mounted on a support bracket (not shown) is a canopy shaped baffle 130 which is electrically grounded. Pressurized gas, such as air, from source 133 is introduced into the development chamber through a plurality of air intake holes, or ports, 137 located in one wall of the development chamber, the gas exiting to that portion of the development chamber beneath baffle 130. Extending through the sidewall of the development chamber directly opposite ports 137 is a toner entrance port 138, also positioned beneath baffle 130. Port 138 is connected to power cloud generator 139, shown in simplified form. A powder cloud generator which may be utilized in the present invention is disclosed in U.S. Pat. No. 3,648,901.

A purge duct 140 is located in the bottom wall of the development chamber through which unused toner is withdrawn during the purge cycle via a purge system 142 comprising a filter and blower means (not shown). At the beginning of the purge cycle, the blower is in communication with he development chamber through the toner filter means and duct 140 whereby unused air borne toner is withdrawn from the development chamber. After the purge cycle, the purging means is removed from communication with the development chamber.

In order to provide automatic and sequential cleaning of the upper surface of baffle 130 and the chamber bottom, a dual wiper blade system is provided. This system comprises a parallel pair of toothed, or notched, belts 141 and 143, each driven by a pair of timing pulleys, only timing pulley 145 being shown in FIG. 3 and wiper blades 147 and 149 mounted to belts 141 and 143 as shown. The timing pulleys are mounted on the same shafts 151 and 153 which drive the development electrode described hereinbelow, whereby the two systems are driven simultaneously, at predetermined times within the cycle, when clutch 144 is engaged. An electrically operable stop, or anchor, 146 is provided to maintain the wiper in a home, or initial, position until the cleaning sequence is initiated. After an initial purge cycle is completed, wiper blades 147 and 149 automatically clean, in sequence, the top of baffle 130 and the chamber bottom after the wiper drive pulley 145 is caused to rotate. A subsequent purge cycle is initiated after the wiper blade assembly cleans the baffle and chamber bottom.

The development chamber 100 incorporates a development, or grid, electrode which comprises a series of parallel wires 162 connected perpendicularly at each end to continuous loop drive members 164 and 166. The parallel wires 162 may comprise any conductive material, such as stainless steel, aluminum, chromium, etc., the typical diameter thereof being approximately 0.060 inches. The effectiveness of the development electrode is dependent on the wire to wire spacing which, in a preferred embodiment, is approximately 0.375 inches. The spacing can be relatively large with respect to the wire diameter to allow the toner to pass easily therethrough.

Xeroradiographic imaging techniques, as utilized in the field of medical diagnostics, may be divided into two general categories, general radiography and mammography. The first category includes images of the extremities, the skull, chest, etc., whereas the latter category relates to imaging of the breast. It has been determined that images of high quality in the first category are obtained when the development electrode is caused to move past the photoconductive surface 108 during the development cycle. In this mode of operation, a negative potential of 2000 volts, for example, is placed on the electrode wires 162 via potential source 179 and voltage divider 181 while a variable negative potential (in the range from approximately 3800 volts to about 4200 volts) is placed on the conductive backing member, or substrate, 106 via bias means 105.

In the second category of imaging, it has been determined that high quality images are produced when no development electrode is utilized. In this mode of operation, a positive potential of approximately 2000 volts is applied to conductive substrate 106 via bias means 105.

Figure 4:
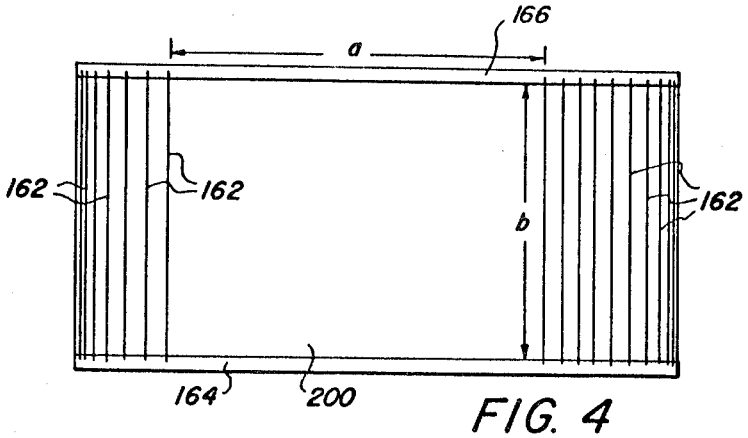
FIG. 4 illustrates a typical layout of the development electrode structure which provides both the far spaced and close spaced electroded modes.

In order to provide this dual mode capability, the development electrode has an open portion 200, shown in layout form in FIG. 4. As will be explained hereinafter, when the system is in the positive mode of operation, the electrode is in the home position and disengaged from the drive pulley, the open portion 200 of the electrode being substantially coextensive with the surface of the photoreceptor. The open section, or gap, is approximately 13.5 inches long (dimension *a*) and 9.5 inches wide (dimension *b*) corresponding to the image area on the photoconductive surface.

The continuous loop drive members 164 and 166 each comprise a pair of toothed, or notched, timing belts (or chains) driven by a pair of pulley systems, the first system (corresponding to continuous loop member 164) pulleys 166, 168, 170 and 172, the second pulley system (corresponding to continuous loop member 166) comprising pulleys 171, 173, 175 and 177, each pulley having a notched circumference to interact with and drive the associated continuous loop member. In the simplified embodiment illustrated, drive mechanism 176, which in the preferred embodiment comprises a variable speed motor to allow control of the development electrode velocity, (typically 5 inches/sec.) is coupled to pulley 174 which functions as the development electrode drive pulley. Gear member 182, having switch actuating pin 183 thereon, is mounted to drive shaft 153. Development electrode home switch 185, mounted to the development chamber, is positioned to be operatively engageable with pin 183, as will be explained in more detail hereinafter with reference to FIG. 7, pin 183 actuating switch 185 once each revolution of shaft 153.

An adjustable grid cam 180 is provided to allow the upper plane of grid wire travel to be closely spaced (0.2 inches, for example) to the surface of photoreceptor 108. Since the position of the grid cam is adjustable by adjusting screws 184 and 186 within their associated slots, the spacings between the upper plane of the grid wire travel and the photoreceptor surface can be varied to obtain a developed image with image contrast/density control. It should be noted that if the cam is adjusted to a value different than the initial setting, appropriate steps should be taken to adjust the belt (or chain) to either provide additional belt (or chain) length or, conversely, take up any slack which may result.

The portion of the development electrode which is not in the image area (the portion of the photoconductive surface 108 exposed to the mixture of toner and air) is routed by cam 180 and the appropriately positioned pulleys 168, 170, 172 . . . as shown in a manner whereby image development is not affected by the development electrode traversals.

A stationary cleaning system 188 comprising inner grid wire cleaning brush 190 and outer grid wire cleaning brush 192 cleans the grid wires as they pass therebetween, the cleaning station 188 being located so as not to interfere with image development.

As shown in FIG. 2 and 3, a commutator strip 194 is formed on the upper surface of adjustable cam 180 and extends at least the length of the development area (dimension a, FIG. 4) and is provided when a rubber timing belt is utilized to bias the electrode wires 162 with the potential from source 179 as the wires traverse the development area. If a chain drive system with sprockets is utilized, the system should be insulated from ground (biasing of the chain drive system may be accomplished by providing a brush contact at a selected location). In the preferred embodiment, the drive mechanism is located outside the toner development area leaving only the electrode wires suspended through the toner development area to avoid toner contamination of the drive mechanism.

Development means 100 is of the powder cloud type wherein a fine cloud of charged toner particles is created by a powder cloud generator (not shown) as disclosed in U.S. Pat. Nos. 2,812,833 or 2,862,646 and blown into the development chamber 100 through port 138. The powder cloud and gas meet under baffle 130 and are thoroughly mixed. Because of the flow rates of the powder cloud generator and the gas, the charged powder cloud within the development chamber is caused to swirl out from under baffle 130 toward the upper portion of the development chamber whereby the charged toner particles are attracted to the latent electrostatic image of the photoconductive layer 108 whereby the latent image is developed. In the preferred mode, the toner cloud generator is pulsed a plurality of times to fill the development chamber with a charge of toner particles. The air flow is preferably pulsed simultaneously with the toner (powder) cloud generator. Alternately, the air flow may be maintained at a constant rate.

At the end of the development cycle, i.e., after the toner is introduced into the development chamber, and during which the latent electrostatic image has been made visible by the attraction of oppositely charged toner particles, the development chamber automatically is in communication with the purge system to entrain unused toner via purge intake filter 150, and the airborne toner is collected in the filter bag within purge system 142. At the end of the purge cycle, the xerographic plate is removed from the development chamber to an image transfer station whereat the powder image on the plate is transferred to receiving material, such as paper.

The baffle 130, which defines the zone in which the toner cloud and the gas flow initially mix, is dimensioned and shaped to provide a uniform distribution of toner in the upper secton of the development chamber as each cloud is moved out from under it during succeeding pulses of the toner and/or gas supply apparatus. In the preferred embodiment, the baffle extends completely between the opposed sidewalls. In general, this movement of the charge powder cloud is affected by the kinetic energy imposed on the toner particles from pulsing the powder cloud generator system and gas supply. The shape of the baffle should be such as to provide for proper charged powder cloud movement to the development zone adjacent the charged xerographic plate.

The parallel conducting elements 162, which are biased oppositely from the polarity of the latent electrostatic image when it is desired to form a negatively sensed reproduction, is utilized to suppress particles which have the opposite polarity as the latent electrostatic image and to establish field lines normal to the photoconductive surface whereby the phenomenon of edge deletion can be controlled as desired. The biased conducting elements 162 also serve to accelerate the movement toward the photoconductive surface of positive particles between the conducting elements 162 and the photoconductive surface.

The accelerated cloud of particles is used in the development of the latent image. The development electrode also assists in controlling the contrast of the developed image by providing an electrostatic field to counteract the fringing fields associated with the edges between adjacent areas of varying charge density. This field causes the toner particles having the desired polarity of charge to move toward the photoconductive surface thereby increasing the effectiveness of the development process.

The magnitude of the bias applied to the conducting elements 162 may be varied by appropriate adjustment of voltage divider 181 whereby control of the positively charged toner particles can be achieved.

Figure 5:
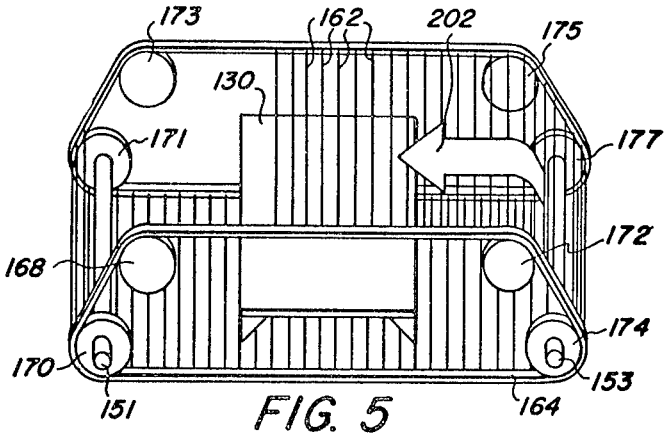
FIG. 5 is a simplified perspective view of the development chamber illustrating the development electrode traversing the xeroradiographic plate.
Figure 6:
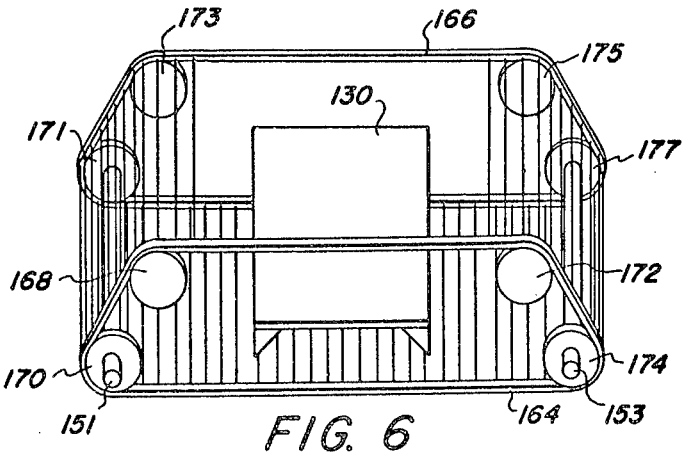
FIG. 6 is a perspective view of the development chamber showing the development electrode at the home position.

In operation, when switches associated with the development chamber indicate that the xerographic plate is in a toner tight relationship with the development chamber, the development cycle is initiated by activating master timing means (not shown). If the negative development mode is to be utilized, the appropriate biasing potentials are applied to the plate substrate 106 and the commutator strip 194 and the development electrode drive mechanism 176 is energized whereby the development electrode is caused to travel in the direction of arrow 202, as shown in FIGS. 1 and 5. Pressurized gas, such as air, is supplied in pulses to ports 137 and the toner powder cloud generator is similarly pulsed one or more times to fill the development chamber with a charge of toner particles, the pulsing of the air and toner particles being accomplished, in the preferred embodiment, simultaneously for improved cloud uniformity. The air and toner particles mix under baffle 130 and are directed to the surface of the photoconductor 108 to develop the latent electrostatic image as explained hereinabove. The development electrode, during development, continuously traverses the development chamber in the direction of arrow 202 to suppress undesirable deletions while the wiper drive system is disengaged and inoperative. At the end of the development cycle, the master timing means causes the development chamber to be in communication with the purge system 142; air drawn through filter 150 entraining unused airborne toner. In this manner, unused toner is purged from the development chamber. During the purge cycle, the development electrode seeks its "home" position (illustrated in FIG. 6), i.e., when gap 200 in the development electrode is substantially opposite the surface of the photoconductor 108. After purge is complete, the xerographic plate is removed from the chamber by elevator means (not shown). At this time, appropriate timing switches, as described hereinafter with reference to FIG. 7, are energized whereby the timing pulley which drives the wiper system is caused to engage with the development electrode drive pulley 174 via clutch 144. At this time, the development electrode drive pulley 174 is caused to rotate and both the wiper aand development electrode are moved in the direction of arrow 204. The wiper blade system is mounted adjacent the gap 200 and returns to its home position as the development electrode returns to its home position shown in FIG. 6.

The wiper blade, after cleaning the top of baffle 130, reverses direction and moves in the direction of arrow 202, cleaning the chamber bottom as described in copending application Ser. No. 323,666, filed Jan. 15, 1973. The wiper blades 147 and 149 are mounted to the wiper blade assembly in a manner whereby wiper blade 147 extends through the gap on the development electrode as it travels in the direction of arrow 200 to allow cleaning of the chamber bottom.

In the positive development mode of operation, the timing pulley 174 which drives the development electrode is disengaged during development and the plate substrate is positively biased via biasing means 105. In this mode of operation, the development electrode remains at the "home" position during development.

After the purge cycle, the plate is removed and the cleaning cycle is initiated in the same manner as described with the negative development mode. In this regard, the development electrode drive pulley is engaged so that the development electrode follows the wiper blade system as described previously.

Brushes 190 and 192 continually clean the inner and outer surfaces of the grid electrode wires 162 as the grid electrode traverses the development chamber 100 in the direction of arrow 202. By limiting toner build-up on the grid wires, adverse affects on the operational characteristics of the development chamber can be virtually eliminated. After the cleaning cycle is completed, the powder images on the plate are subsequently transferred to a support sheet, the powder iamge is then permanently fused to the sheet, the plate then being cleaned and processed for subsequent re-use.

To further define the specifics of the present invention, the following examples are intended to illustrate and not limit the particulars of the present system. Parts and percentages are by weight unless otherwise indicated.

EXAMPLE I

An XA-201 Head Neck Phantom patient test object supplied by Andersen Research Labs, Inc., Stamford, Conn., is exposed to penetrating X-ray radiation supplied by a Picker G350S single phase with 3mm aluminum total filtration tungsten anode at 120kv and 40mas at 36 inches tube-to-plate distance. The radiation passes through the test object onto a 135 micron commercially available selenium plate. Prior to exposure, the plate is charged to 1600 volts and upon exposure is found to be discharged to approximately 800 volts. The latent electrostatic image thus obtained is developed employing a black commercially available toner in a Xerox 125 System which is commercially available in accordance with apparatus and development techniques more specifically outlined in U.S. Pat. No. 3,640,246, directed to a far spaced electroded development system by Jeromin and Hoyt. Seven bursts of black toner are employed with a back bias of −2250 applied and −500 volts on the control grid. The plate is then again developed employing blue toner in a close spaced electrode system, more specifically described in the Klingenberg application, U.S. Ser. No. 525,698. In this development step, a grid bias of −200 volts is applied and a back bias of −3500 volts. The resultant image is found to have black enhanced sharp edge and small detail image superimposed over a blue more absolute image. The image has color contrast as well as tonal contrast to make an image having greater information content as well as easier diagnostic appreciation.

EXAMPLE II

The procedure outlined in Example I is again performed with the exception that the blue development step is performed in the commercially available Xerox 125 System at −3000 volt back bias and −500 voltage applied on the control grid. Similar results to those obtained in Example I are observed as in Example I.

EXAMPLE III

The procedure as outlined in Example I is again peformed with the exception that nine bursts of black toner and 12 bursts of blue toner are employed.

EXAMPLE IV

The procedure as outlined in Example I is again performed with the exception that 12 bursts of black toner are employed and nine bursts of blue toner.

Although the present examples were specific in terms of conditions and materials used, any of the above-listed typical materials may be substituted when suitable in the above examples with similar results. In addition to the steps used to carry out the process of the present invention, other steps or modifications may be used if desirable. In addition, other materials may be incorporated in the system of the present invention which will ehance, synergize, or otherwise desirably affect the properties of the systems for their present use.

Anyone skilled in the art will have other modifications occur to him based on the teachings of the present invention. These modifications are intended to be encompassed within the scope of this invention.

What is claimed is:

1. A xeroradiographic imaging method comprising the steps of providing an electrophotographically photoconductive member, uniformly charging said photoconductive member, exposing said member to a pattern of penetrating radiation to form a charge pattern thereon, developing said charge pattern with a first colored toner employing a far spaced electrode so that the charge pattern is developed substantially field-wise, and then developing the charge pattern with a colored toner of a contrasting color employing a closely spaced electrode so that the charge pattern is developed substantially in accordance with the charge residing on the photoconductive member.

2. The method as defined in claim 1 wherein said far spaced electrode is positioned in such a manner that the field emanating from the charge pattern on said photoconductive member is virtually uneffected.

3. The method as defined in claim 1 wherein said first toner is black and said contrasting toner is blue.

4. The method as defined in claim 1 wherein said penetrating radiation is made through an object and impinges upon the photoconductive plate to selectively discharge it resulting in the formation of said charge pattern.

5. A method of developing a xeroradiographic image including the development of both sharply changing and slowly changing object boundaries including the steps of uniformly charging an electrophotographically photoconductive member, selectively discharging said charged photoconductive member by passing penetrating radiaton through an object to produce a latent electrostatic image and developing said image employing contrasting toners both in the fringe field, i.e., field-wise and in the absolute mode, i.e., charge-wise, the improvement which comprises developing said latent electrostatic image with a colored toner in the presence of a far spaced electrode which results in the development of the latent electrostatic image substantially in accordance with the electric field emanating therefrom and then again developing said latent electrostatic image with toner of contrasting color to said first colored toner employing a closely spaced electrode so that the image is now developed substantially in accordance with the charge pattern residing on said photoconductive member.

6. The method as defined in claim 5 wherein said first and second development steps are accomplished by employing powder cloud developing techniques.

* * * * *